US007686890B2

(12) United States Patent
King et al.

(10) Patent No.: US 7,686,890 B2
(45) Date of Patent: Mar. 30, 2010

(54) DISHWASHER CONTROL SYSTEM

(75) Inventors: Jonathan D. King, Cedar Grove, TN (US); Dean A. Werthman, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 1156 days.

(21) Appl. No.: 11/288,235

(22) Filed: Nov. 29, 2005

(65) Prior Publication Data

US 2007/0119478 A1 May 31, 2007

(51) Int. Cl.
*B08B 7/04* (2006.01)
*B08B 3/00* (2006.01)

(52) U.S. Cl. ..... 134/18; 134/56 D; 134/58 D; 134/25.2

(58) Field of Classification Search ..... 134/18, 134/25.2, 56 D, 58 D
See application file for complete search history.

(56) References Cited

U.S. PATENT DOCUMENTS 3,911,943 A 10/1975 Athey et al.
5,306,995 A 4/1994 Payne et al.
5,377,707 A * 1/1995 Young, Jr. ..... 134/104.1
6,648,981 B2 11/2003 McIntyre et al.
2001/0039190 A1 11/2001 Bhatnagar
2002/0147878 A1 10/2002 Kuerner et al.
2003/0037806 A1 2/2003 McIntyre et al.
2003/0084928 A1 5/2003 Wood
2004/0004635 A1 1/2004 King

* cited by examiner

*Primary Examiner*—Joseph L Perrin
*Assistant Examiner*—Benjamin Osterhout
(74) *Attorney, Agent, or Firm*—Kirk W. Goodwin; Diederiks & Whitelaw PLC

(57) ABSTRACT

A dishwasher includes a plurality of electrical wash system components connected to a control system constituted by a user interface controller and a main controller. The user interface controller includes a plurality of user input selectors for establishing model dependent operational parameters for a washing operation. The main controller broadcasts an information packet regarding a desired washing operation in the form of a first set of instructions associated the model dependent operational parameters and a second set of instructions associated with other dishwasher models. The dishwasher is then operated based upon the first set of instructions, while the second set of instructions are automatically filtered out.

20 Claims, 3 Drawing Sheets

DISHWASHER CONTROL SYSTEM

BACKGROUND OF THE INVENTION

1. Field of the Invention

The present invention pertains to the art of dishwashers and, more particularly, to a dishwasher control system.

2. Discussion of the Prior Art

Automatic dishwashers are typically provided with a control system that manage various cycles of an overall wash operation. Generally, the various cycles include wash, rinse and dry operations. Prior to each wash and rinse cycle, an amount of water is admitted into a washing chamber portion of the dishwasher. During the wash cycle, the water is mixed with a detergent solution to form a washing liquid. The washing liquid or, in the case of the rinse cycle, water is pumped to one or more rotating spray arms that direct jets of washing liquid or water onto kitchenware or the like being washed in the washing chamber.

In the past, the control systems typically employed mechanically operated rotary switches in initiating and terminating the various cycles. Over time, the control systems developed into solid state systems that allowed a consumer to initiate a wash cycle at the push of a button, with multiple control buttons being typically arranged on a user interface portion of the dishwasher. Depending upon the particular model dishwasher, the number, style and location of the buttons will differ. At present, many dishwashers include computer controls that provide more washing options and a greater level of control over the washing operation. In addition, many user interfaces now include a display section that presents information, such as current cycle, selected options and time remaining information, to a consumer.

The particular type of user interface incorporated into a dishwasher is typically model dependent. That is, high end dishwasher models include a user interface that provides a consumer with a greater degree of control over a washing operation as compared to low end models. More specifically, the high end models will not only enable consumers to choose more options, such as sanitize cycles, pot scrubbing cycles, and the like for the washing operations, but provide displays that provides the consumers with a great deal of information, while low end models are limited to more basic washing cycles and displays.

In all cases, the user interface communicates consumer inputs to a main controller which subsequently controls various wash system components. However, as each user interface is different, supporting derivative models presents a challenge to manufacturers. That is, in general, each derivative model requires a distinct main controller programmed to communicate with a distinct user interface controller. In some cases, the main controller is required to communicate with a user interface controller and display elements that are physically separated a considerable distance on the dishwasher. When the components are widely separated, a great deal of wiring is required to provide the necessary lines of communication. Developing and maintaining a main controller for each dishwasher model, or incorporating excessive wiring to support physically separated display elements, adds to the overall cost and complexity of the appliance, not to mention the costs for training technicians, as well as developing and updating manuals associated with the diagnosis and repair of problems.

Based on the above, there exists a need for a universal dishwasher control system. More specifically, there exists a need for a universal main controller that can communicate commands to a variety of distinct user interface controllers regardless of the type, design or complexity of the user interface.

SUMMARY OF THE INVENTION

The present invention is directed to control system for a dishwasher. In general, the dishwasher includes a tub and a plurality of electrical wash system components connected to the tub. The electrical wash system components are selectively activated to establish a flow of washing fluid during a washing operation, as well as perform drain and heating operations. In accordance with the invention, the dishwasher also includes a user interface controller. The user interface controller receives input through a plurality of user input selectors for selectively establishing model dependent operational parameters for the washing operation. That is, the plurality of user input selectors enable a consumer to make various selections for the washing operation. The number and type of selections available to the consumer are dependent upon the particular model of dishwasher.

In accordance with the most preferred form of the invention, the dishwasher includes a main controller operatively connected to the user interface controller and the plurality of electrical wash system components. The main controller receives user inputs from the user interface controller and broadcasts status information to the user interface controller regarding a desired washing operation. The status information takes the form of a universal instruction packet.

In further accordance with the most preferred form of the invention, the universal instruction packet includes a first set of instructions associated with the model dependent operational parameters and a second set of instructions associated with other dishwasher models. That is, regardless of the user interface controller incorporated into the dishwasher, the main controller broadcasts a defined set of instructions. However, the user interface controller only acts upon the instructions that address features incorporated into the particular model of dishwasher. Therefore, the instructions associated with features not present in the particular dishwasher are ignored or filtered out. With this arrangement, the main controller need not include information or special programming associated with the particular user interface controller incorporated into the dishwasher and thus can be employed in all available, as well as future, dishwasher models.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
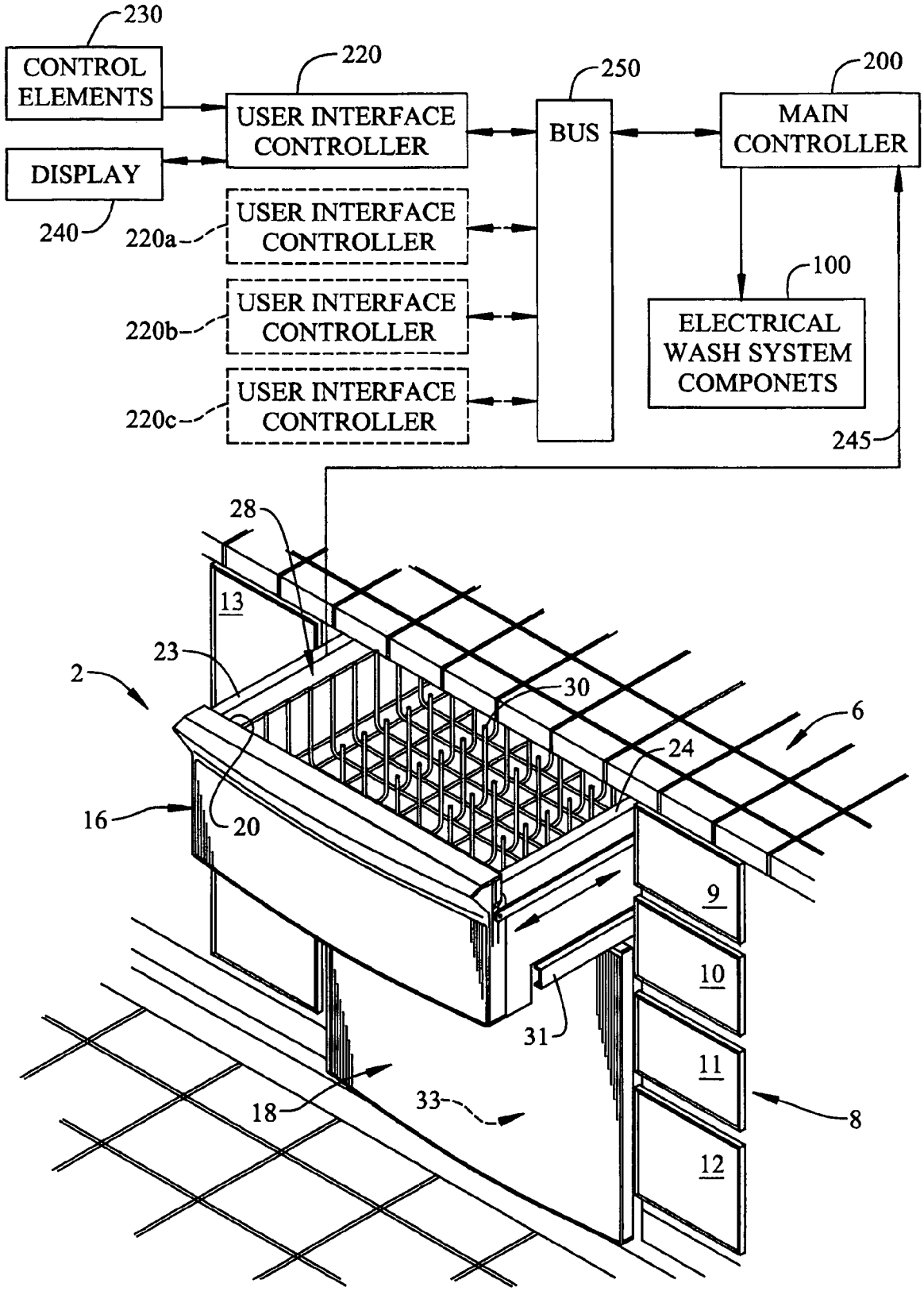
FIG. 1 is an upper right perspective view of a drawer-type dishwasher incorporating a control system constructed in accordance with the present invention.
Figure 2:
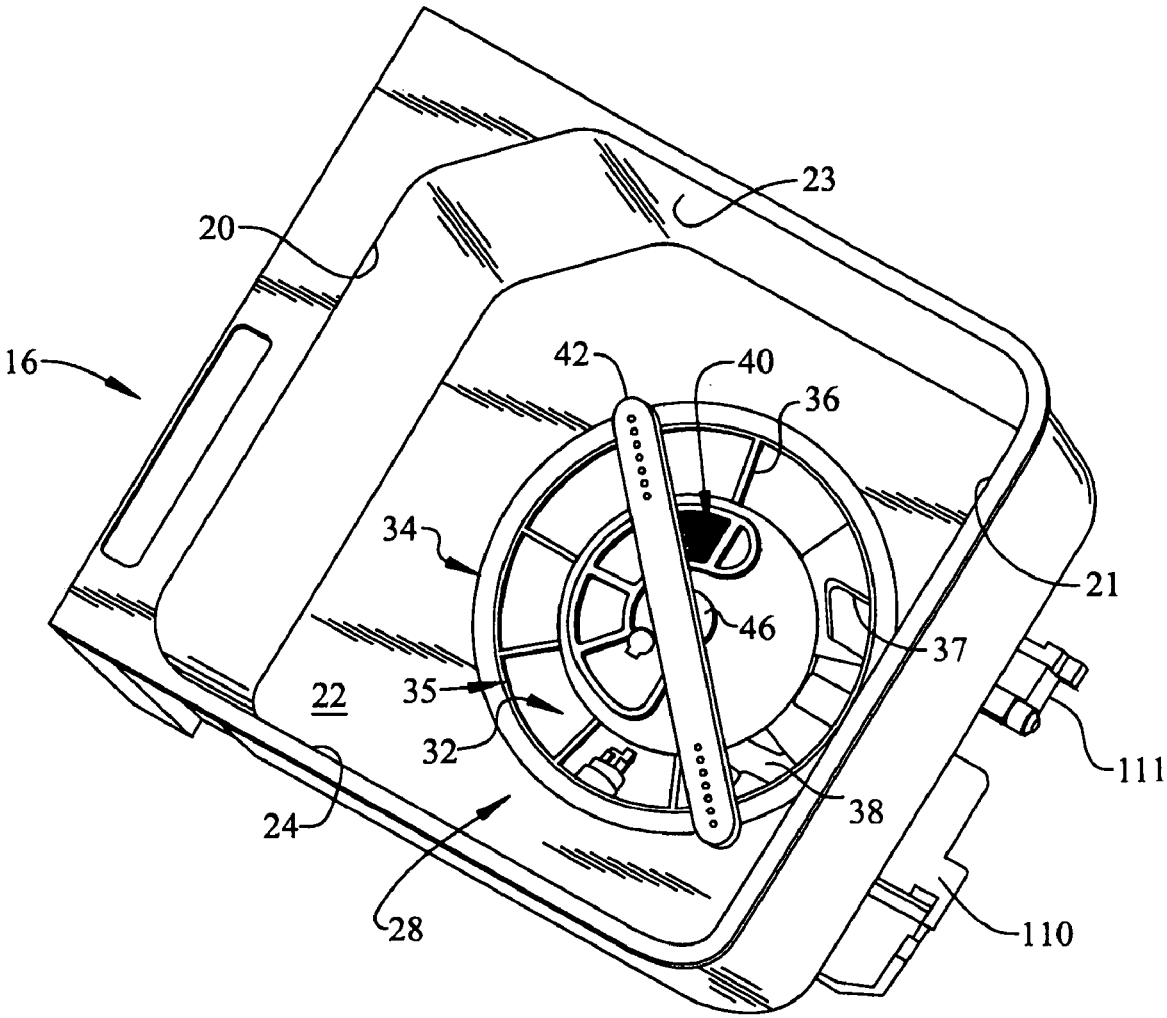
FIG. 2 is an upper perspective view of a washing chamber portion of the dishwasher of FIG. 1.
Figure 3:
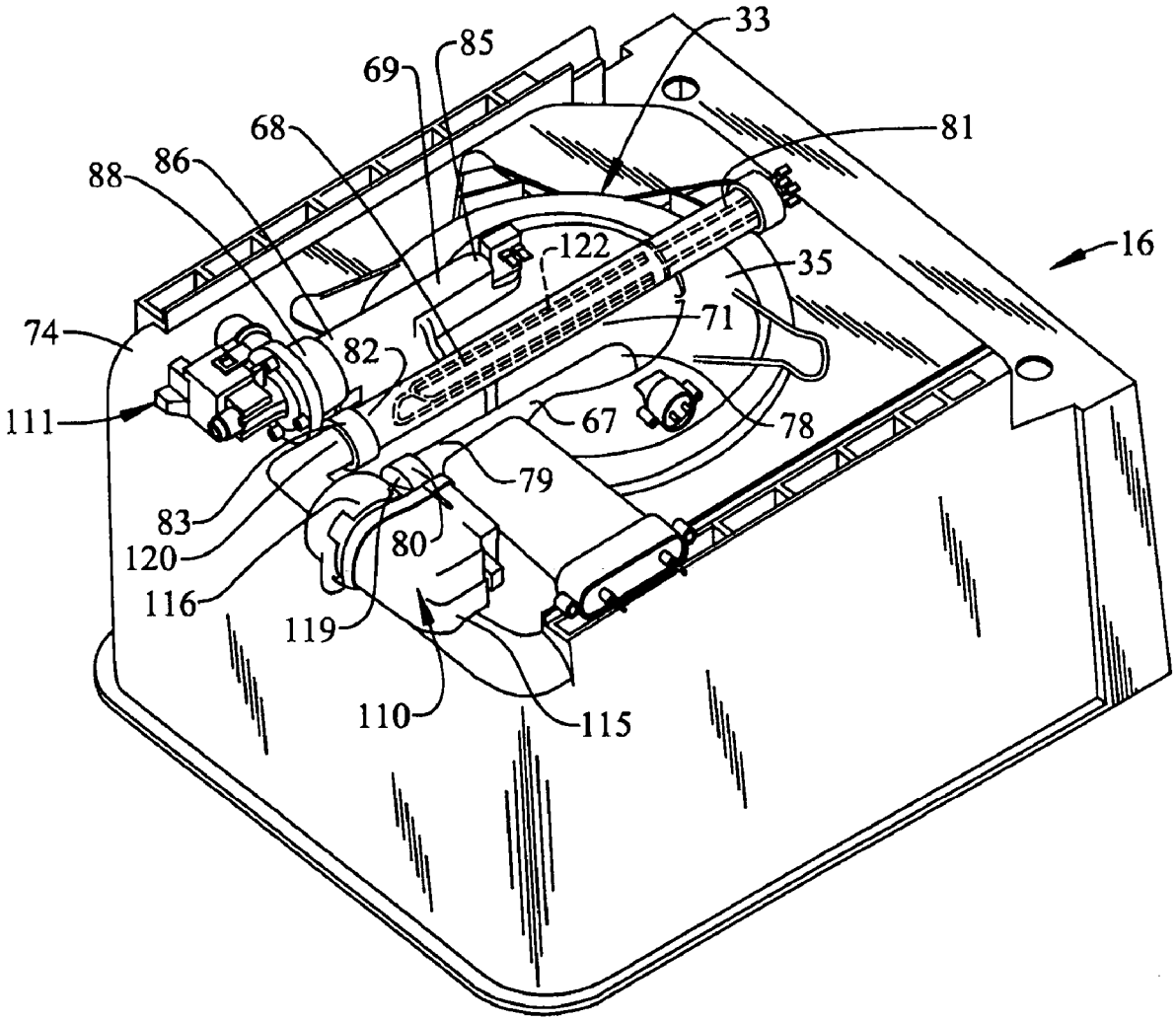
FIG. 3 is a lower perspective view of the washing chamber of FIG. 2, illustrating a plurality of electrical wash system components that are selectively activated to establish a washing operation.

With reference to FIGS. 1-3, a dishwasher constructed in accordance with the present invention is generally indicated at 2. Dishwasher 2 includes an outer housing (not shown) arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a multi-compartment drawer-type dishwasher having an upper compartment 16 and a lower compartment 18. As best illustrated in FIG. 1, upper compartment 16 takes the form of a slide-out drawer unit having a small or medium capacity so as to be used for cleaning glassware and the like, while lower compartment 18 is illustrated as a larger capacity drawer for washing items such as dinnerware, cookware and other large sized objects. Of course, upper and lower compartments 16 and 18 could be of similar size. Also, dishwasher 2 could include a single pull-out drawer or simply constitute a more conventional dishwashing unit.

Upper compartment 16 is shown to include a front wall 20, a rear wall 21, a bottom wall 22 and opposing side walls 23 and 24 that collectively define an upper washing chamber or tub 28. Upper washing tub 28 is provided with a dish rack 30 for supporting various objects, such as glassware, utensils and the like, to be exposed to a washing operation. Upper compartment 16 is slidingly supported within the outer housing through a pair of extendible support guides, one of which is indicated at 31. In the embodiment shown, bottom wall 22 actually forms part of a sump 32 that, as will be discussed more fully below, manages a flow of washing fluid within upper compartment 16. Although not shown, lower compartment 18 similarly includes front, rear, bottom and opposing side walls that collectively define a lower washing chamber or tub 33.

As best shown in FIGS. 2 and 3, bottom wall 22 is provided with a recessed portion 34 having a generally U-shaped cross section that defines an intake ring 35. A coarse particle strainer 36 extends about recessed portion 34 to trap/prevent large soil particles from entering sump 32. Towards that end, coarse particle strainer 36 includes a plurality of openings, one of which is indicated at 37, that are provided with coarse filter screens (not shown) formed from, for example, a polyester mesh, plastic or stainless steel. The large soil particles trapped by coarse particle strainer 36 are ultimately collected in a coarse particle collection chamber 38, while other, smaller particles enter into sump 32 and collect in a fine particle collection chamber 40. Also shown in FIG. 2 is a wash arm 42 that is rotatably supported upon a hub 46. In a manner known in the art, wash arm 42 emits jets of water and/or washing fluid that are directed onto the various objects supported on dish rack 30.

Referring specifically to FIG. 3, sump 32 includes a plurality of fluid conduits 67-69 integrally formed along bottom wall 22 of washing tub 28. However, in an alternative arrangement, conduits 67-69 could be detachably secured to bottom wall 22. In any case, fluid conduit 67 constitutes a wash fluid supply conduit, fluid conduit 68 constitutes a wash fluid recirculation conduit and fluid conduit 69 constitutes a wash fluid drain conduit. Each of fluid conduits 67-69 provides wash fluid flow management during a washing operation. Preferably, fluid conduits 67-69 are spaced from and arranged substantially parallel to one another on bottom wall 22, with conduits 67 and 69 extending from a central portion 71 of intake ring 35 to an outer edge portion 74 of washing tub 28. More specifically, supply conduit 67 includes a first end 78 which is in fluid communication with wash arm 42 and leads to a second end 79 that is provided with an attachment flange 80. Likewise, recirculation conduit 68 extends from a first end 81, which extends beyond intake ring 35 towards a front portion of compartment 16, to a second end 82. In a manner similar to that described for supply conduit 67, recirculation conduit 68 is provided with a corresponding attachment flange 83. Finally, drain conduit 69 extends from a first end 85 to a second end 86 which is also provided with an associated attachment flange 88.

In addition to managing the flow of washing fluid in dishwasher 2, sump 32 serves as a mounting platform for a plurality of electrical wash system components which are generically represented at 100 in FIG. 1. As more specifically illustrated in FIGS. 2 and 3, electrical wash system components 100 include a wash pump 110 and a drain pump 111 that are shown connected to washing tub 28 along outer edge portion 74. Preferably, wash pump 110 includes a wash motor housing 115 and a wash pump housing 116. More preferably, wash pump housing 116 includes an outlet 119 and an inlet 120 that conducts washing fluid back from washing tub 28 to pump housing 116. In addition to wash pump 110 and drain pump 111, electrical wash system components 100 include a heater element 122 that is positioned within recirculation conduit 68. Heater element 122 is selectively activated to heat the washing fluid that is circulating into and out of washing tub 28 during a wash portion of the washing operation.

The above described structure has been provided for the sake of completeness and to enable a better understanding of the overall invention. Actually, a more detailed description of the above-described structure and can be found in commonly assigned U.S. patent application Ser. No. 11/052,862 filed on Feb. 9, 2005, which is incorporated herein by reference. Again, the present invention is being described with reference to drawer-type dishwasher 2, but is not intended to be limited in this respect. Instead, the present invention is directed to a control system for dishwasher 2.

In accordance with the invention as represented in FIG. 1, dishwasher 2 includes a main controller 200 that is operatively connected to the plurality of electrical wash system components 100. Main controller 200 manages the washing operation selected for washing tub 28. More specifically, based upon inputs received through a user interface controller 220, main controller 200 selectively activates the plurality of electrical wash system components 100 to establish the washing operation in washing tub 28. That is, after loading washing tub 28 with kitchenware to be washed and adding detergent, a consumer selects, through a plurality of user input selectors or control elements 230, a desired washing cycle, as well as desired cycle options. The cycle, cycle options and, preferably cycle time remaining are presented to the consumer on a display 240. Of course, the number and type of cycles and cycle options available are dependent upon the particular model of dishwasher. High end models will include cycles and cycle options that are not present in low end models. Actually, certain models may only be provided with control elements 230, while other models employ a touch display 240. Towards that end, main controller 200 is designed to communicate not only with user interface controller 220, but with a plurality of different user interface controllers such as indicated at **220*a*-220*c*. In addition, main controller 200 receives signals from various sensors, such as temperature, turbidity and the like sensors (not shown) through a line 245**, with the number and type of sensors also being model dependent.

In accordance with the most preferred form of the invention, main controller 200 receives inputs in the form of event data from user interface controller 220. The event data generally includes generic commands such as start, stop, pause etc., as well as user interface specific commands (cycle and cycle options) such as sanitize, tough scrub, heated dry, extra rinse, normal wash, heavy wash and the like. Main controller 200 interprets the event data and activates electrical wash system components 100 accordingly. More specifically, during the washing operation, main controller 200 broadcasts information to user interface controller 220. That is, main controller 200 broadcasts status data back to user interface 200, particularly to update display 240. For example, main controller 200 provides status information to display 240 in the form of display settings, cycle time remaining, cycle selected, options selected and/or current cycle information.

In further accordance with the most preferred form of the invention, the status data broadcast by main controller 200 to user interface controller 220 takes the form of a universal instruction packet. The universal instruction packet includes a first set of instructions that are associated with model dependent operational parameters, as well as a second set of instructions that are associated with other available dishwasher models. More specifically, the first set of instructions are associated with the cycles, cycle option and other parameters actually, physically preset in the particular model dishwasher. The second set of instructions are associated with operational parameters that address options not actually, physically provided in the particular dishwasher model.

With this arrangement, main controller 200 can universally communicate with the plurality of user interface controllers 220 and 220*a*-220*c* without being associated with any particular dishwasher model. Once the universal instruction packet is received at, for example, user interface controller 220, the first set of instructions are acted upon and presented on display 240, while the second set of instructions are filtered out and simply ignored by user interface controller 220. Thus, the present invention establishes a universal control system that can be incorporated into any number of different dishwasher models.

In order to ensure proper lines of communication, main controller 200 is preferably linked to user interface controller 220 through a communication bus 250. Communication bus 250 can take the form of a serial and/or parallel connection, a peer-to-peer connection or the like. In this manner, a manufacturer can reduce the overall material costs associated with creating a distinct user interface element and main controller for each dishwasher model, or the need for excessive wiring or specific programming for a main controller, thereby allowing for a reduction in the overall design, construction and maintenance costs.

Although described with reference to a preferred embodiment of the invention, it should be readily understood that various changes and/or modifications can be made to the invention without departing from the spirit thereof. For instance, while the link between main controller 200 and user input controller 220 is described as a serial or parallel connection, other forms of communication, such as wireless protocols, are also acceptable. Also, while the electrical wash system components are described as including a wash pump, drain pump and heater, other components, such as sensors, dispensers and the like are also encompassed. In general, the invention is only intended to be limited by the scope of the following claims.

We claim:

1. A method of operating a dishwasher comprising:

manually inputting model dependent operational parameters of a washing operation into a user interface controller;

broadcasting a universal instruction packet of control commands from a main controller, said universal instruction packet including a first set of instructions associated with the model dependent operational parameters and a second set of instructions associated with operating parameters for other dishwasher models, with said second set of instructions being inoperative with the model dependent operational parameters; and performing the washing operation by acting upon the first set of instructions associated with the model dependent operating parameters at the user interface and filtering out the second set of instructions associated with operating parameters for other dishwasher models.

2. The method of claim 1, wherein the universal instruction packet is broadcasted to the user interface controller.

3. The method of claim 2, wherein the universal instruction packet is broadcasted to the user interface controller through a communication bus.

4. The method of claim 1, further comprising: displaying operational information based on only the first set of instructions to a user.

5. A dishwasher comprising:

a washing chamber;

a plurality of electrical wash system components for establishing a flow of washing fluid in the washing chamber during a washing operation;

a user interface controller including a plurality of user input selectors for establishing model dependent operational parameters of the washing operation; and a main controller operatively connected to the user interface controller and the plurality of electrical wash system components for selectively controlling the washing operation, said main controller configured to broadcast a universal instruction packet including a first set of instructions associated with the model dependent operational parameters and a second set of instructions used to control operating parameters for other dishwasher models, with said second set of instructions being inoperative with the model dependent operational parameters, wherein said user interface controller acts upon the first set of instructions associated with the model dependent operational parameters and filters out the second set of instructions associated with other dishwasher models.

6. The dishwasher according to claim 5, wherein the universal instruction packet is sent from the main controller to the user interface controller.

7. The dishwasher according to claim 6, wherein the user interface controller and the main controller are linked through a communication bus.

8. The dishwasher according to claim 5, wherein the universal instruction pack includes status data.

9. The dishwasher according to claim 8, wherein the status data includes information selected from the group consisting of: cycle selected, cycle time remaining, display settings and options selected.

10. The dishwasher according to claim 8, wherein the main controller receives event data in the form of generic commands from the user interface controller.

11. The dishwasher according to claim 10, wherein the event data includes information selected from the group consisting of: start commands, stop commands, pause commands and user interface controller specific commands.

12. The dishwasher according to claim 11, wherein the event data includes user interface specific commands selected from the group consisting of: a sanitize cycle, heating commands, tough scrub cycle, normal wash cycle, heavy wash cycle and an extra rinse cycle.

13. The dishwasher according to claim 5, wherein the electrical wash system components include a wash pump, a drain pump and a heating element.

14. A dishwasher comprising:

a tub having bottom, rear and opposing side walls that define, at least in part, a washing chamber;

a plurality of electrical wash system components connected to the tub, said electrical wash system components establishing a flow of washing fluid in the washing chamber during a washing operation;

a main controller operatively connected to the plurality of electrical wash system components for selectively controlling the washing operation;

a user interface controller operatively connected to the main controller, said user interface controller including a plurality of user input selectors for establishing model dependent operational parameters of the washing operation;

means for broadcasting control commands from the main controller, said control commands including a universal instruction packet having a first set of instructions associated with the model dependent operational parameters, as well as a second set of instructions used to control operating parameters for other dishwasher models, with said second set of instructions being inoperative with the model dependent operational parameters; and means for receiving the universal instruction packet, acting upon the first set of instructions associated with the model dependent operational parameters and filtering out the second set of instructions associated with other dishwasher models.

15. The dishwasher according to claim 14, wherein the universal instruction packet is sent from the main controller to the user interface controller.

16. The dishwasher according to claim 15, wherein the broadcasting means is constituted by a communication bus.

17. The dishwasher according to claim 14, wehrein the universal instruction pack includes status data.

18. The dishwasher according to claim 17, wherein the status data includes information selected from the group consisting of: cycle selected, cycle time remaining, display settings and options selected.

19. The dishwasher according to claim 17, wherein the main controller receives event data in the form of generic commands from the user interface controller.

20. The dishwasher according to claim 19, wherein the event data includes information selected from the group consisting of: start commands, stop commands, pause commands and user interface controller specific commands.

* * * * *

UNITED STATES PATENT AND TRADEMARK OFFICE

CERTIFICATE OF CORRECTION

PATENT NO. : 7,686,890 B2
APPLICATION NO. : 11/288235
DATED : March 30, 2010
INVENTOR(S) : King et al.

It is certified that error appears in the above-identified patent and that said Letters Patent is hereby corrected as shown below:

Claim 8, column 6, line 48, change "pack" to --packet--.

Claim 17, column 8, line 11, change "wehrein" to --wherein--.

Claim 17, column 8, line 12, change "pack" to --packet--.

Signed and Sealed this

Second Day of November, 2010

David J. Kappos

David J. Kappos
*Director of the United States Patent and Trademark Office*